United States Patent [19]

Gröf et al.

[11] 4,339,624

[45] Jul. 13, 1982

[54] ELECTRODE CLAMPING DEVICE FOR ELECTROREMELTING PLANTS

[75] Inventors: Helmut Gröf, Bruchkobel; Uwe Reimpell; Anton Wamser, both of Hanau am Main, all of Fed. Rep. of Germany

[73] Assignee: Leybold-Heraeus GmbH, Cologne, Fed. Rep. of Germany

[21] Appl. No.: 120,236

[22] Filed: Feb. 11, 1980

[30] Foreign Application Priority Data

Feb. 15, 1979 [DE] Fed. Rep. of Germany ..... 2905752
Dec. 15, 1979 [DE] Fed. Rep. of Germany ..... 2950531

[51] Int. Cl.[3] ..... H05B 7/10
[52] U.S. Cl. ..... 373/52
[58] Field of Search ..... 13/14–17, 13/13, 9 ES; 219/73.1, 125.1, 138

[56] References Cited

U.S. PATENT DOCUMENTS

| | | | |
|---|---|---|---|
| 1,499,922 | 7/1924 | Hadaway | 13/14 |
| 1,691,365 | 11/1928 | Woodson | 13/14 |
| 2,818,494 | 12/1957 | Bernard et al. | 219/125.1 |
| 3,614,285 | 10/1971 | Holzgruber | 13/14 |
| 3,651,238 | 3/1972 | Schlienger | 13/15 |
| 3,804,146 | 4/1974 | Hoyle | 219/73.1 |
| 4,251,678 | 2/1981 | Grof et al. | 13/15 |

FOREIGN PATENT DOCUMENTS

| | | |
|---|---|---|
| 1816450 | 7/1969 | Fed. Rep. of Germany . |
| 2134089 | 2/1972 | Fed. Rep. of Germany . |

*Primary Examiner*—Bernard Roskoski
*Attorney, Agent, or Firm*—Felfe & Lynch

[57] ABSTRACT

An electrode clamping device in an electroslag remelting plant has an adjustment device which defines two pivot axes for the electrode holding member which are aligned at right angles to one another and which can be independently controlled for effecting pivotal movement of the electrode holding member about the two axes.

21 Claims, 11 Drawing Figures

FIG. 9
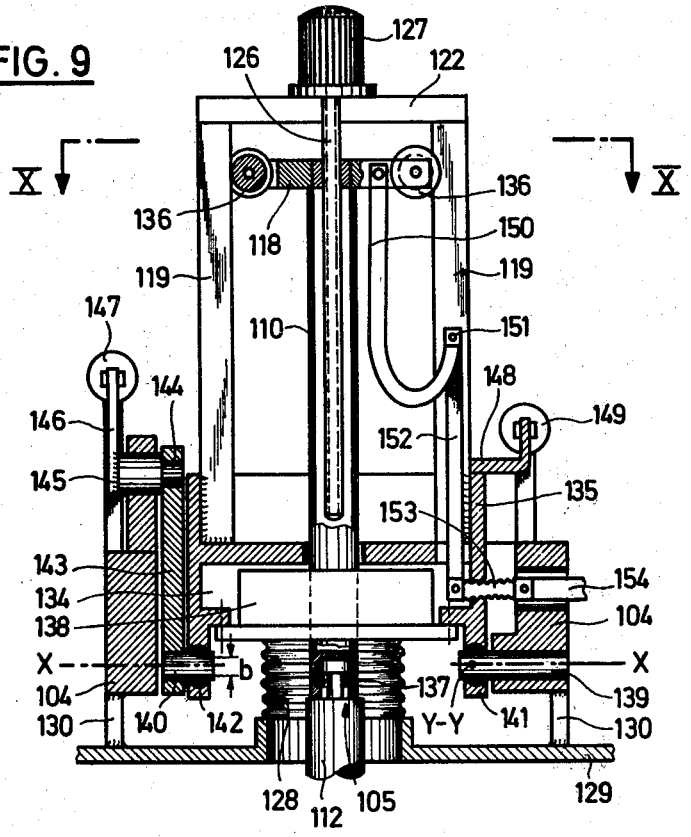
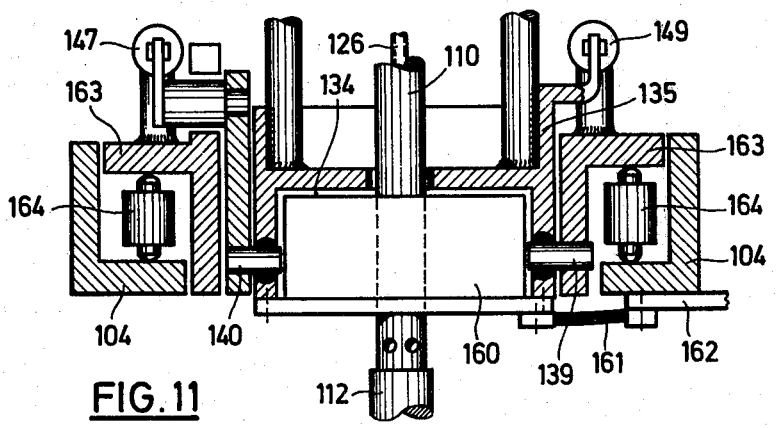
FIG. 11

ELECTRODE CLAMPING DEVICE FOR ELECTROREMELTING PLANTS

BACKGROUND OF THE INVENTION

The present invention relates to an electrode clamping device with an electrode holding unit for electroremelting plants equipped with a mold and an electrode carrying device, in which at least one adjustment device is arranged for adjusting the angular position of the electrode holding member and electrode.

Such electrode clamping devices for electroslag remelting plants are known for example from German Offenlegungsschrift No. 1,816,450 and German Auslegeschrift No. 21 34 089. The adjustment devices in these cases are in the form of a cardan or universal joint in which the electrode, on account of its center of gravity and the force due to gravity, can align itself to such an extent that, for example, the effect of an obliquely welded-on clamping end (stub) is largely compensated. By maintaining appropriate frictional conditions within the cardan joint, it is possible to make the electrode adjustable only externally. With the known devices it is however not possible, if there are variations in the electrode position within the mold, to influence selectively or purposefully the electrode plant or effect remedial measures. When remelting an individual consumable electrode according to the electroslag remelting process within a mold, it is however desirable to arrange the mold and electrode as concentrically as possible so that the slag bath is as symmetrical as possible on all sides. The concentricity or axial symmetry is extremely important as regards the melting process, the heat profile in the slag bath and molten metal, and also as regards the solidification conditions of the metallic melt.

The X-Y-adjustment devices disclosed in German Offenlegungsschrift No. 25 12 169 and German Offenlegungschrift No. 27 31 227 relate to the horizontal movement of the consumable electrode during the remelting operation. These adjustment devices are associated with geared motors having spindles in the X and Y directions. The electrodes are suspended in horizontally movable carriages. However, the electrode axis can only be displaced parallel to itself, and an angular adjustment of the electrode axis with respect to the reference point is not possible. For this reason these adjustment devices cannot be used in vacuum electric arc furnaces, since the electrode rod there present and located within a sealed duct prevents any parallel movement of the electrode.

If there is too small a distance between the electrode and mold wall on one side, there is the danger that in the case of electric arc furnaces the arc, or in the case of electroslag remelting furnaces the current path, will take the shortest route between the electrode and mold wall. In this case a localized melting of the mold wall may occur, and if the mold is cooled by water the danger of the steam explosion cannot be excluded.

The ability to adjust the electrode is particularly important when replacing an electrode, in which a further electrode must be mounted in the shortest possible time in its remelting position once the previous electrode has been consumed. For the aforementioned reasons it is essential when mounting the subsequent electrode to carry out position corrections by rotating the electrode axis. This could not be done in a selective manner however with the previously known devices.

SUMMARY OF THE INVENTION

The object of the present invention is thus to provide an electrode clamping device of the type described at the beginning, by means of which a selective adjustment of the electrode can be carried out not only before the remelting process but also during the remelting process, without having to touch the electrode—which is under tension—for this purpose. In particular, it is intended that the electrode will be able to be adjusted by remote control.

The aforementioned objective is achieved in accordance with the invention with the electrode clamping device described at the beginning if the adjustment device has two defined pivotal axes X—X and Y—Y which are aligned at right angles to one another and with which are associated independently controllable adjustment drive means.

In contrast to the state of the art, in which of course an adjustment in the X—Y coordinate system is also possible, with the subject matter according to the invention the two pivotal axes exist physically and materially, and—again in contrast to the cardan joint—an adjustment drive means is associated with each one of them, by means of which the electrode holding member can be controllably adjusted about X—X axis and/or the Y—Y axis.

If when adopting the teaching according to the invention the operating staff of the remelting plant detect an eccentricity of the consumable electrode and mold or a deviation from the predetermined position, it is easily possible in the aforementioned way and without touching the electrode to adjust the latter in a purposeful and selective manner and restore it to its prescribed position. This is also possible any time during the remelting process, if for example the electrode axis does not maintain a rectilinear orientation and accordingly the electrode adjustment has to be altered from time to time. This is also the case if the electrode and its clamping end adopt an angular position with respect to one another, as is shown in an exaggerated manner in German Offenlegungsschrift No. 18 16 450. The reduction in mass of the electrode during the remelting process in any case does not take sufficient account of the fact that the lower end of the electrode—and this is the only important factor—must be situated concentrically in the mold. In this connection it should of course be borne in mind that with such plants, in which the electrode carrying devices move downwardly on account of existing guide means during the remelting of the electrode, the downward movement takes place essentially in a strictly vertical manner. Even if the electrode carrying device can pivot in the horizontal direction by virtue of an existing pivotal axis, any positional adjustment or compensation can take place only in the tangential direction to the pivotal radius and not in the radial direction. Moreover, such electrode carrying arms generally lack the drive means necessary for a fine adjustment.

An ideal possibility for adjusting the angular position of the electrode with complete coverage of the X—Y coordinate system exists if both pivotal axes X—X and Y—Y run horizontally and preferably intersect one another. In such a case the electrode carrying device does not need to be pivotable, i.e. the solution according to the invention can also be used in electroslag remelting plants constructed according to the portal or gantry principle, in which a cross arm, rigid per se, is preferably arranged in a vertically movable manner on two fixed pillars or is guided on a pair of rails in the manner of a crane bridge. With electroslag remelting plants, which however are equipped with an electrode carrying device that can pivot about a vertical axis, a simplified embodiment having sufficient degrees of freedom for the electrode movement can be achieved if the vertical pivotal axis for the electrode carrying device, which axis in any case already exists, is used as one of the two defined pivotal axes for the electrode adjustment. Such an electrode clamping device is characterized according to a further feature of the invention by the fact that with an electrode carrying device which can pivot together with the adjustment device about a vertical axis on a circular path, the pivotal axis X—X is tangential to the circular path, and the other pivotal axis, i.e. the Y—Y axis, is the vertical axis of the electrode carrying device. With such an arrangement the lower electrode end can move about the X—X axis radially to the pivotal axis of the electrode carrying device, i.e. to the axis of the fixed column, whereas the movement of the lower electrode end in the vertical direction thereto is effected by rotation about the vertical Y—Y axis. It can be seen that the electrode thereby executes only a partial parallel displacement, which is however sufficient for many applications.

In the case of an electrode carrying device which can swivel together with the adjustment device about a vertical axis on a circular path K, the spatial position of the pivotal axes X—Y and Y—Y is selected in a particularly advantageous manner in such a way that the pivotal axis X—X runs tangentially to the circular path and the pivotal axis Y—Y runs parallel to a radius of the circular path.

The arrangement is advantageously chosen in such a way as regards the X—X axis that an adjustment drive means is arranged between the electrode holding member and the electrode carrying arm, by means of which the electrode holding member can be adjusted about the pivotal axis X—X. The additional equipment associated with the electrode carrying arm, such as for example an intermediate frame supported by several weight measuring cells on the electrode carrying device, should be regarded as integral with the electrode carrying arm. This particular possibility will be described in more detail hereinafter.

A particularly advantageous adjustment device for the electrode holding member is characterized according to a further feature of the invention in that the pivotal axis X—X is formed by two pegs that engage bilaterally in the electrode holding member, one of which is rigidly secured to the electrode carrying device (or on the intermediate frame) and the other of which is secured, displaced eccentrically by an amount "a," on a swivel pin rotatably mounted on the electrode carrying device (or in the intermediate frame), wherein the pivotal axis X—X and the rotational axis of the swivel pin in its central position lie in a horizontal plane, and spherical bearings are arranged between the peg and the electrode holding member.

In this case it is sufficient for the swivel pin to have a rotational movement in order to displace the eccentric peg upwardly or downwardly from the horizontal plane, whereupon the electrode holding member moves by a corresponding amount about the Y—Y axis. It can be seen that the crank radius of the eccentric peg is large compared to the angular range traversed by the eccentric peg, and accordingly the peg executes an approximately linear movement.

In order to be able to carry out the adjustment movements about the individual axes, uninfluenced as far as possible by one another, it is recommended according to a further feature of the invention to arrange a jib on the electrode holding member, which has a spherical bearing for connecting the jib to the associated adjustment drive means in order to arrange the midpoint of the spherical bearing on the Y—Y axis but outside the X—X axis.

The application of the technical solution according to the invention is in no way restricted to arranging the pivotal axes and peg as well as the associated adjustment drive means directly in the electrode carrying device. Instead, it is possible to arrange the structural parts on an intermediate frame, this being a particularly advantageous arrangement. In this way there is a complete compensation of forces and reaction forces within the intermediate frame, with the result that it is possible to arrange the intermediate frame on a plurality of weight measuring cells fixed to the electrode carrying device. In this connection, the weight measuring cells are preferably distributed equidistantly on the circumference of a circle aligned concentrically with respect to the electrode axis and to the axes of the electrode holding member. The ability to measure the weights of consumable electrodes has recently become increasingly important in controlling the remelting process. By measuring the overall value of the electrical output signals from the individual weight measuring cells, the total weight of the electrode can be measured exactly independently of any inclination or nonverticality of the electrode.

In some of the embodiments the consumable electrodes are placed in pivotable electrode carrying devices, so-called electrode carrying arms, secured to a vertically movable electrode carriage. By lowering the electrode carriage on a fixed guide column, the consumable electrodes can be guided into the mold depending on their consumption. The solution according to the invention is however not absolutely dependent on a fixed column and on an electrode carriage that can move vertically on the latter.

An advantageous alternative solution is characterized according to a further feature of the invention in that a guide device and a drive means are secured to the electrode holding member, by means of which an electrode rod can be displaced axially with respect to the electrode carrying device. All structural elements which permit a displacement of the electrode rod along its own axis and relative to the electrode holding member, so that the electrode rod can swivel together with the electrode holding member, are suitable as a guide device.

The aforedescribed advantages of the electrode holding member that can move about defined pivotal axes by means of adjustment drive means are retained. In addition there is the advantage that the raising and lowering drive means for the consumable electrode, which is essential for the continuous remelting of the electrode as well as for charging new electrodes, is mounted on the electrode carrying device. Thus, a so-called fixed column can be dispensed with if there is a lack of space and it is possible to mount the electrode carrying device rigidly and directly on a wall of the electroremelting room. A guide device consisting of columns and cross-beams in conjunction with a suitable arrangement of the power supply permits a coaxial or quasi-coaxial arrangement of the current paths. This is of considerable advantage, particularly when using alternating current for the remaining, since with non-coaxial current supply, the losses increase with the frequency. If the columns are sufficiently long the electrodes can be reliably guided even in cases where the electrodes are long. A suitably long electrode rod has the advantage that the consumable electrode can be consumed to a small residual mass even without a correspondingly long clamping end, if an ingot is made up of several consumable electrodes. In this connection, the most unfavorable conditions exist in fact when the first consumable electrode has been completely consumed, since in this case the molten metal above the upper end of the ingot is situated deep down in the bottom of the mold. Reliable guidance of the electrode is also important in connection with remelting electrodes of rectangular cross-section in so-called ingot slab molds. Finally, the technical solution according to the invention is of particular advantage in vacuum electric arc furnaces, in which the electrode movement has to be transmitted in a vacuum-tight manner to the interior of the furnace by means of a suitably long electrode rod.

A particularly simple and reliable guide device is characterized according to a further feature of the invention in that the device is a vertical frame in the central position, consisting of columns and crossbeams, in which frame the electrode rod is guided parallel to the columns.

In the case of vacuum electric arc furnaces in which the electrode rod is surrounded in a vacuum-tight manner by a sealing member, connected by means of a compensator (bellows) to the upper part of the furnace, it is particularly advantageous to arrange the center of the compensator essentially in a plane defined by the X—X and Y—Y axes. In this way, with a purposeful and selective pivoting of the electrode or electrode rod, the compensator is forced to execute exclusively flexural movements, for which it has been designed. A transverse displacement of the end of the compensator remote from the upper part of the furnace is thus largely excluded. The frame follows the movement of the electrode axis, depending on the specific setting of the adjustment drive means.

Further advantageous arrangements of the subject matter of the invention are described hereinafter and are to be understood to be within the scope of the invention.

Three embodiments of the subject matter of the invention and specific details thereof are described in more detail hereinafter with the aid of the attached drawings, wherein:

BRIEF DESCRIPTION OF THE DRAWINGS

FIG. 9 is a front view of the electrode carrying device according to the invention in section, on which the electrode holding member together with the adjustment drive means is located, as is employed in the plant according to FIG. 8.

DETAILED DESCRIPTION OF THE INVENTION

Figure 1:
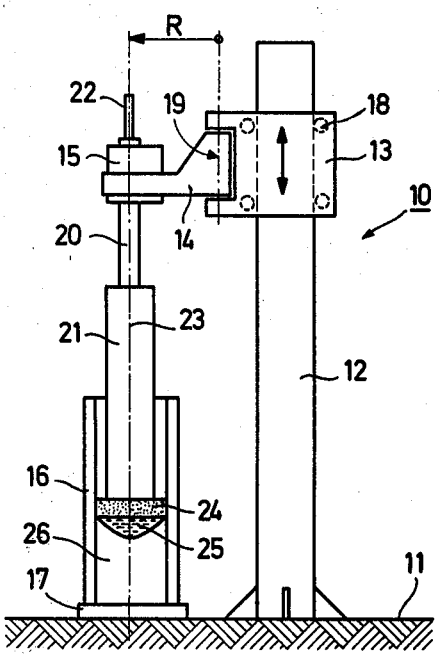
FIG. 1 is a diagrammatic side view of an electroslag remelting plant according to the invention including a fixed column and electrode carriage, in which the mold is shown in section.

FIG. 1 shows an electroslag remelting plant 10 consisting of a base 11, a fixed column 12, an electrode carriage 13, an electrode carrying device 14 with an electrode clamping device 15 and a water-cooled fixed mold 16 with a mold floor 17. The electrode carriage 13 is arranged on the fixed column 12 in such a way that it can move vertically by means of rollers 18 and corresponding roller guides, as is connected via a vertical pivotal axis 19 to the electrode carrying device 14. A clamping end 20 belonging to the consumable electrode 21 is arranged in the electrode clamping device 15, but is not remelted with the said consumable electrode. The upper end of the clamping end 20 has an eye 22 for transportation purposes and for suspending the consumable electrode 21 in the electrode clamping device 15. The electrode has a geometrical axis 23 whose distance from the pivotal axis 19 represents the pivotal radius R which defines the horizontal circular path for the pivotal movement of the electrode 21.

A layer of molten slag 24 through which the electrode 21 is melted is located within the mold 16. The melt initially accumulates to form a pool of molten metal 25 and then solidifies into an ingot 26, which represents the preliminary end product of the electroslag remelting process. The melting process itself as well as the electroslag remelting plant shown in FIG. 1 belong to the state of the art, with the exception of details of the electrode clamping device 15, and accordingly will not be described further hereinafter.

Figure 2:
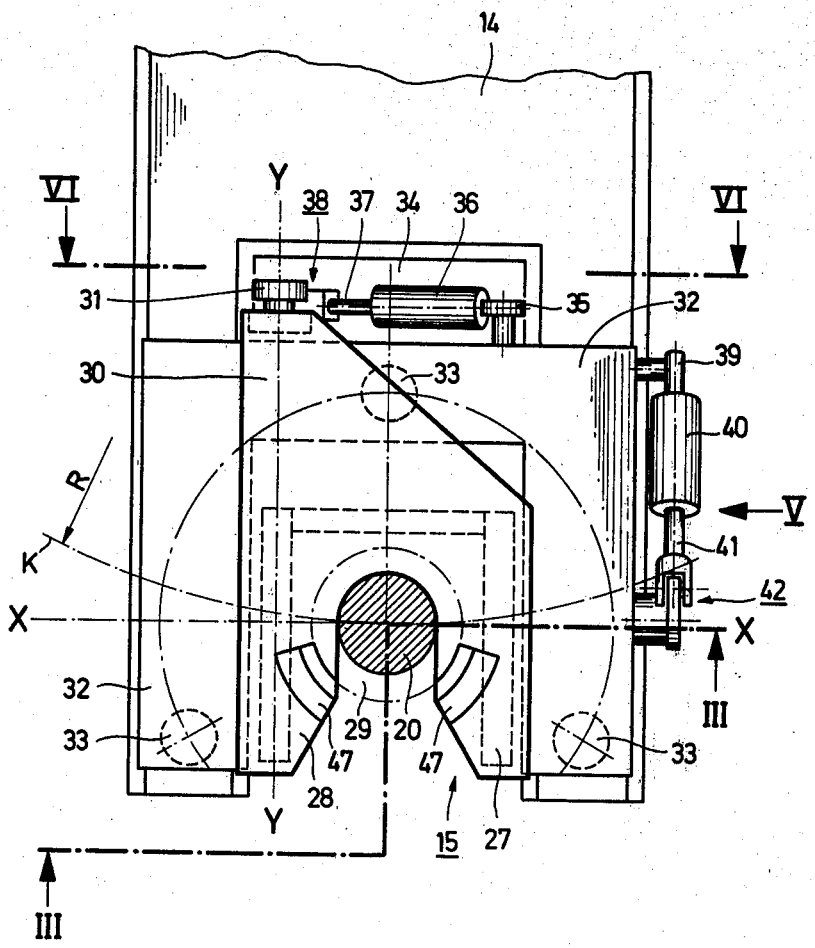
FIG. 2 is a top view of the end of the electrode carrying device of FIG. 1, on which the electrode holding member and its adjustment drive means are located.

FIG. 2 illustrates the external end of the electrode carrying device 14, which contains the electrode clamping device 15, whose central axis is defined by the pivotal radius R and which, for its own part, determines the circular path K, only part of which is shown. The electrode clamping device 15 consists of an electrode holding member 27 which is made in the shape of a horizontal "U" with a front pointing opening and is closed at the top by means of a carrying plate 28 shown in outline in thicker lines for the sake of clarity. The carrying plate 28 has on its front face, within the electrode holding member 27, a recess 29 for the insertion of the clamping end 20, and at its asymmetrically formed rear end a jib 30 at whose end is located a spherical bearing 31. The electrode holding member 27 and carrying plate 28 are rigidly connected to one another.

The electrode holding member 27 is surrounded on three sides by a U-shaped intermediate frame 32 supported by three weight measuring cells 33, arranged equidistantly on a circle, on the electrode carrying device 14. The electrode holding mmber 27 is arranged in a rectangular recess 34 within the electrode carrying device 14, the recess extending considerably further in the direction of the fixed column 12 than the intermediate frame 32.

Figure 6:
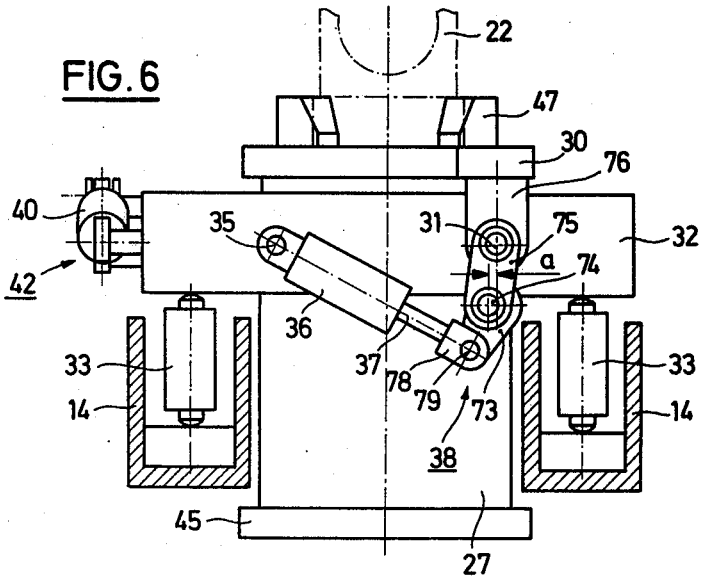
FIG. 6 is a section along the line VI—VI in FIG. 2, along a plane parallel to the top view according to FIG. 3.

A pressure medium cylinder 36 is arranged on the intermediate frame 32 by means of a link 35, the piston rod 37 of the cylinder acting on an adjustment drive means 38, details of which will be shown in more detail in FIG. 6, and which for its own part acts on the spherical bearing 31 in such a way that the latter, and together with it the carrying plate 28 opposite the intermediate frame 32, can be pivoted in a direction vertical to the plane of the drawing, namely about the pivotal axis X—X. Moreover, a further pressure medium cylinder 40 is arranged via a link 39 on the intermediate frame 32, the piston rod 41 of this cylinder co-operating with an adjustment drive means 42, details of which can be seen in more detail in FIGS. 3 and 4, and in particular in FIG. 5.

Figure 3:
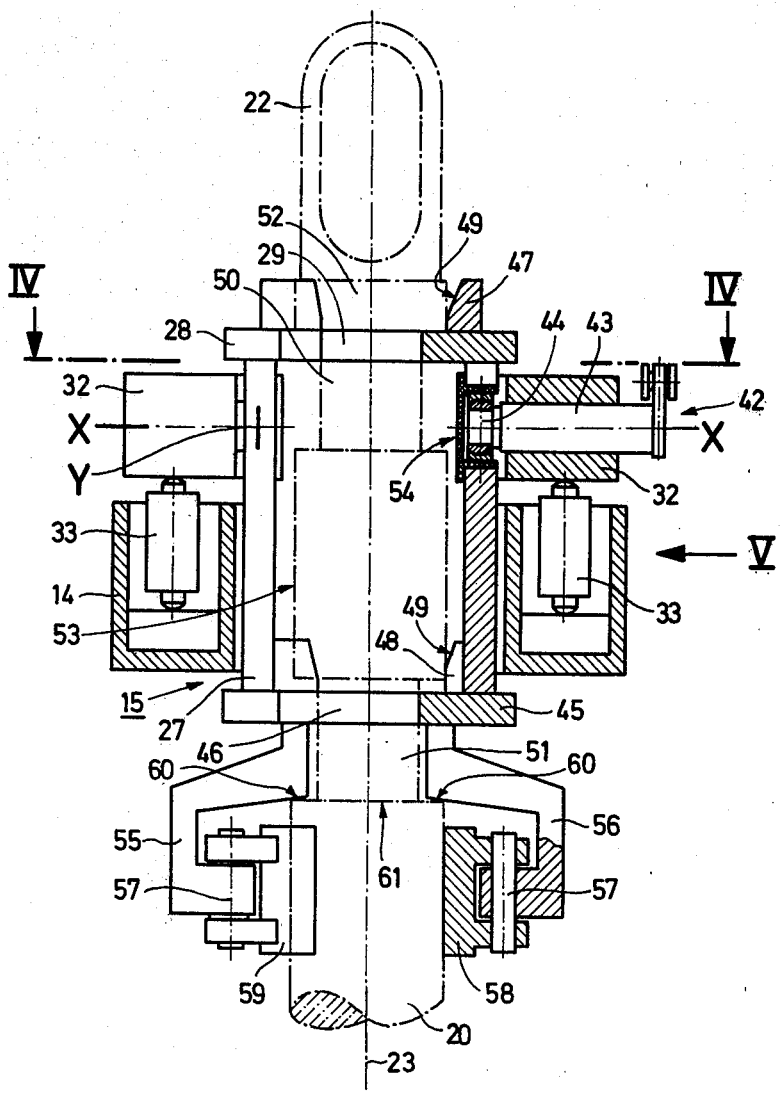
FIG. 3 is a front view in conjunction with a partial section through the object of FIG. 2 along the line III—III therein.
Figure 4:
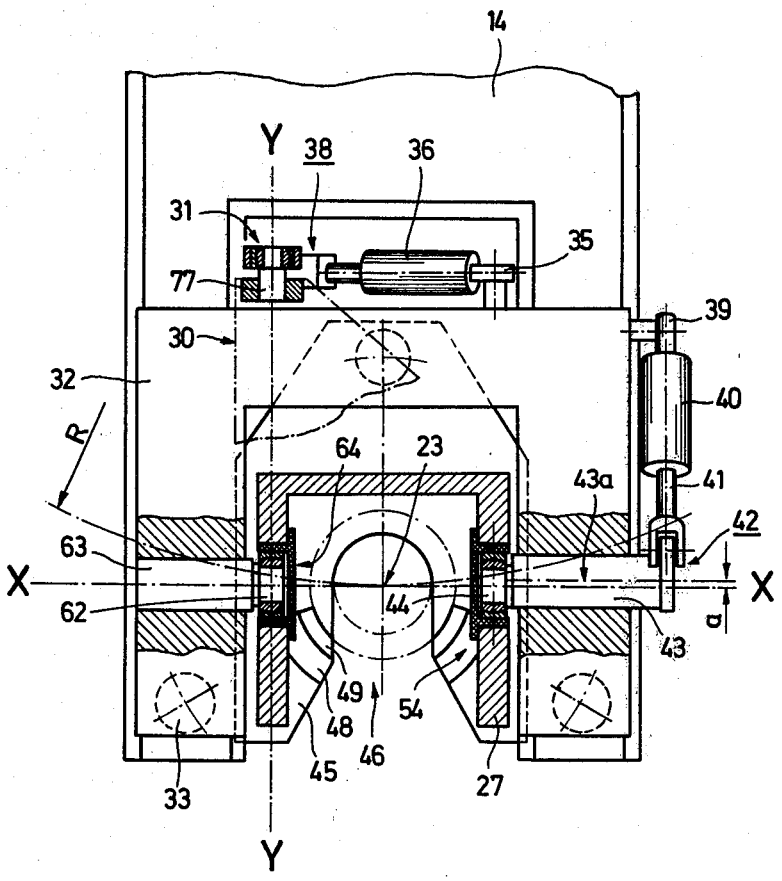
FIG. 4 is a section through the device of FIG. 3 along the line IV—IV, in a plane parallel to the top view according to FIG. 2.

The adjustment drive means 42 acts on a swivel pin 43 which is mounted in the intermediate frame 32 and cooperates via an eccentric peg 44 according to FIGS. 3 and 4 with the electrode holding member 27. On rotating the swivel pin 43 it is possible by means of the peg 44 to pivot the electrode holding member 27, and together with it the carrying plate 26, about a horizontal axis Y—Y, which runs, inter alia, through the spherical bearing 31, and is thus orientated laterally displaced with respect to the mid-axis of the recess 29. The further definition of the pivotal axis Y—Y is shown in more detail in FIG. 4. By virtue of the presence of the pivotal axes X—X and Y—Y positioned at right angles to one another and lying in a horizontal plane, it is in any case possible to pivot in a selective manner the electrode holding member 27 and the carrying plate 28 in the direction of two corrdinates by an amount limited by the design data and specifications of the adjustment drive means 38 and 42. The pressure medium cylinders 36 and 40 are, for this purpose, connected to pressure medium lines (not shown) in order to be able to influence the adjustment drive means 38 and 42 in a defined manner.

From FIG. 3 it can be seen that a closure plate 45 is arranged on the bottom of the electrode holding member 27 which, with the exception of the jib 30, essentially corresponds in outline to the shape of the carrying plate 28. The closure plate 45 is also provided with a front opening 46. Centering devices 47 and 48 are arranged on the circumference of the recesses 29 and 46 on the carrying plate 28 as well as on the closure plate 45, these centering devices being provided with conical surfaces 49 whose vertices are directed downwardly. For co-operation with the centering devices 47 and 48, the clamping end 20 is provided with recesses 50 and 51 through which collars 52 and 53 are formed. After the electrode has been suspended, the collar 52 is supported via its lower surface on the carrying plate 28, whereas the collar 53 comes to rest within the centering device 48 but outside the closure plate 45. It can be seen that the centering devices 47 and 48 act in the radial direction on the clamping end 20 and the electrode 21, and thereby localize the latter in the electrode clamping device 15. As can be seen from FIG. 2, the centering device 47 (and in a similar manner, of course, also the centering device 48) surround the respective collar 52 (and 53), with the result that the clamping end 20 can be inserted into the electrode clamping device 15 and removed therefrom only in a position that is raised compared with FIG. 3. It follows that the extent to which the electrode is raised is at least as great as the axial height of the centering device 47.

It can also be seen from FIG. 3 that the peg 44 of the adjustment drive means 42 engages, by means of a spherical bearing 54, in the right-hand lateral cheek of the electrode holding member 27. Since the axes of the swivel pin 43 and peg 44 are arranged displaced by an amount "a" according to FIG. 4 in a plane running vertically to the plane of the drawing and lying in the pivotal axis X—X, it follows that when the swivel pin 43 executes a pivotal movement the right-hand cheek of the electrode holding member 27 executes a forwards or backwards movement about the pivotal axis Y—Y, which likewise runs vertically to the plane of the drawing according to FIG. 3. The sum of all the vertical forces is transferred from the electrode holding member 27 to the intermediate frame 32 and thereby to the weight measuring cells 33 which are supported on the electrode carrying device 14, which is formed having an upwardly open box-shaped profile in the region of the weight measuring cells 33.

Two tong jaws 55 and 56 of a pair of contact tongs are arranged in mirror symmetry with respect to one another on the lower side of the closure plate 45, the tong jaws co-operating via articulated shafts 57 with electrical pressure contacts 58 and 59 adapted to the surface of the clamping end 20. In this way the melting current is conducted to the electrode via current connections (not shown in more detail) on the pressure contacts. The tong jaws 55 and 56 at the same time form a locking device for the clamping end 20. To this end, locking surfaces 60 are provided on the lower side of the approximately radially running parts of the tong jaws, the surfaces bearing against an upper annular front surface 61 of the clamping end 20 when the tong jaws are closed. In this way an unintentional removal of the electrode from the device when the full melting current is flowing is effectively prevented.

From FIG. 4, and with aid of FIGS. 2 and 3, the following features can be recognized, that is, the axis of the peg 44 is displaced by an amount "a" of a few mm compared with the axis of the swivel pin 43, and in fact both axes lie in a plane that coincides with the cross-section plane according to FIG. 4. The axes of the peg 44, which is also the axis of the spherical bearing 54, coincides in the center position shown in FIG. 4 with the pivotal axis X—X, and also coincides with it outside the center position, with the exception of extremely small angular deviations. A further peg 62 is located coaxially on the side opposite the peg 44 (in the center position), and is rigidly mounted in the intermediate frame 32 by means of an extension 63 and thereby bears directly against the electrode carrying device 14. The pivotal axis X—X passes not only through the peg 62 but also through the extension 63. A spherical bearing 64 whose midpoint together with the midpoint of the spherical bearing 31 defines the pivotal axis Y—Y is also arranged on the peg 62.

The mode of operation of the device can be derived from FIG. 4 as follows: if only the pivotal pin 43, starting from the center position as illustrated, is moved, then the electrode holding member 27 executes pivotal movements about the pivotal axis Y—Y, i.e., the electrode axis 23 moves in the X—X direction or parallel thereto. In on the other hand the swivel pin 43 and thus the peg 44 are held in illustrated position and only the jib 30 moves by means of the spherical bearing 31 and adjustment drive means 38 vertically to the plane of FIG. 4, the electrode holding member 27 executes a pivotal movement about the pivotal axis X—X, i.e. the electrode axis 23, which runs vertically to the plane of the drawing, will move parallel to the Y—Y direction. Since in each case two spherical bearings, namely 54/64 or 31/64, lie on one of the pivotal axes, there is no mutual influence on the adjustment. It is however directly possible to produce an overlapping of the movements, namely by actuating both adjustment drive means 38 and 42, which overlapping can occur either in the same direction or in opposite directions. The part of the electrode axis 23 lying outside the point of intersection of the pivotal axes can accordingly reach within a limited range, every point of the coordinate system with positive and negative signs. The electrode can be reliably held in this position by locking the adjustment drive means 38 and 42 and/or by locking the pressure medium supply to the pressure medium cylinders 36 and 40.

Figure 5:
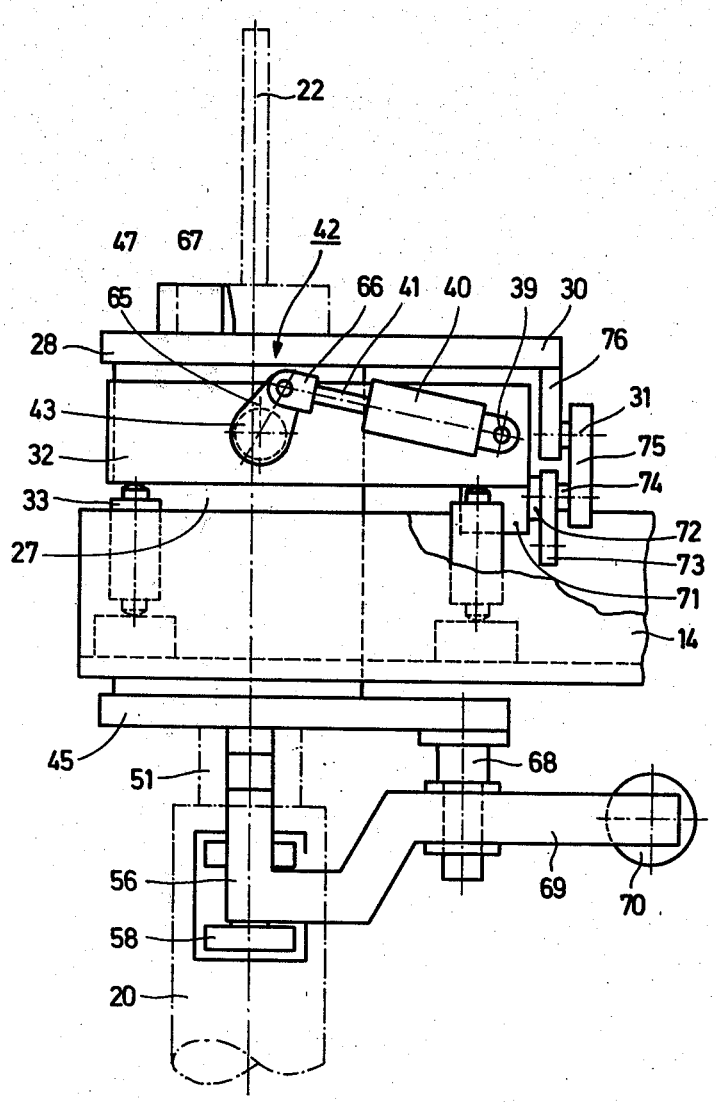
FIG. 5 is a side view of the device of FIGS. 2 and 3 in the direction of the arrow via FIG. 3.

From FIG. 5 it can also be seen how the adjustment drive means 42 is constructed. A single-arm lever 65 is situated on the swivel pin 43, the piston rod 41 of the pressure medium cylinder 40 is being secured to the lever 65 by means of a fork 66 and a bolt 67. By suitably charging this pressure medium cylinder 40 it is possible to bring the swivel pin 43 into the desired position and hold it in this position.

A bearing pin 68 is located at the rear end of the closure plate 45, the two tong jaws 55 and 56, of which only the front one 56 can be seen in FIG. 5, being articulatedly mounted on the bearing pin 68. The tong jaws are extended beyond the bearing pin 68 by the lever 69, between which is situated a further pressure medium drive means 70. In this way it is possible to press the pressure contacts 58 and 59 reliably against the clamping end 20.

Finally, further details of the adjustment drive means 38 for the adjustment about the pivotal axis X—X can be derived from FIG. 6 in conjunction with FIG. 5. To this end, a bearing pin 72 having a horizontal axis is arranged on a continuation 71 of the reference platform 32, a single-arm lever 73 being pivotally mounted on the bearing pin 72. An eccentric peg 74 whose axis is displaced horizontally by an amount "a" compared with the axis of the bearing pin 72 is arranged on this lever 73 (FIG. 6). A connecting plate 75 joined to the spherical bearing 31, which for its part is secured to a continuation 76 of the jib 30, is arranged on the peg 74. The spherical bearing 31 is joined to the continuation 76 via a bearing pin 77 (FIG. 4). The lever 73 communicates with the piston rod 37 of the pressure medium cylinder 36 via a fork 78 and a bolt 79. It is clear from FIG. 6 that upon actuation of the pressure medium cylinder 36, the lever 73 executes pivotal movements which are converted into a vertical movement of the peg 74. The connecting plate 75, extension 76, and thereby the jib 30 of the carrying plate 28 follow this vertical movement.

Figure 7:
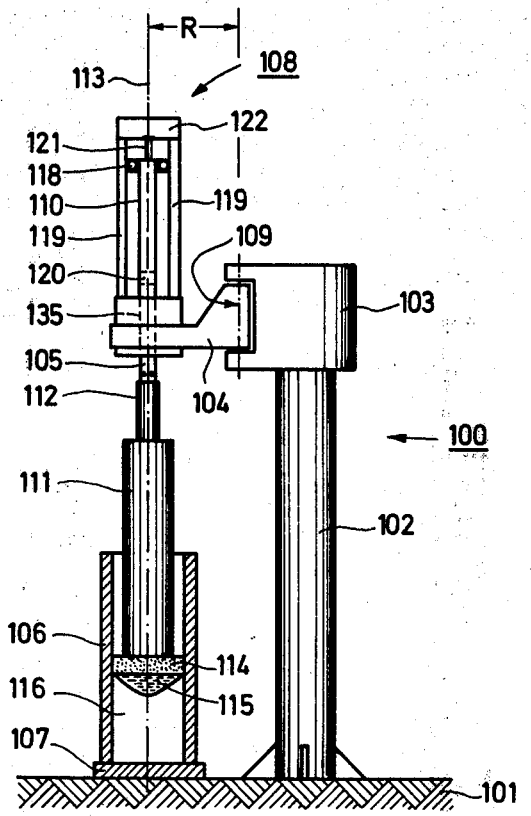
FIG. 7 is a diagrammatic side view of an electroslag remelting plant according to the invention and similar to FIG. 1, but without an electrode carriage.

FIG. 7 shows an electroslag remelting plant 100 consisting of a base 101, a fixed column 102 with an axial holder 103, an electrode carrying device 104 with an electrode clamping device 105, and a water-cooled mold 106 with a mold floor 107. The axial holder 103 is joined to the electrode carrying device 104 via a vertical pivotal axis 109. The electrode clamping device 105 is arranged at the lower end of an electrode rod 110 belonging to the plant. A consumable electrode 111 is inserted into the clamping device 105 and connected thereto in an electrically conductive manner by means of a clamping end 112 welded to the electrode. The electrode 111 has a geometrically axis 113 whose distance from the pivotal axis 109 represents the pivotal radius R defining the horizontal circular path for the pivotal movement of the electrode 111.

Within the mold 106 a layer of molten slag 114 is formed during the illustrated remelting process, the electrode 111 being melted under the action of the melting current fed to the slag. The melt initially collects to form a bath of molten metal 115 and then solidifies into an ingot 116, which constitutes the preliminary end product of the electroslag remelting process. The melting process together with the electroslag remelting plant illustrated in FIG. 7 belong to the state of the art, with the exception of the details of the present invention that will be described more fully hereinafter, and accordingly will not be discussed further.

The electrode clamping device 105 is guided radially at its lower end and is suspended at its upper end from a transverse beam 118, provided at both ends with rollers which run on vertical columns 119. The electrode rod 110 is formed as a pressure medium cylinder. An internal piston 120 is suspended via a piston rod 121 on a crossbeam 122, which rests directly on the electrode carrying device 104 via the columns 119, in the manner illustrated in FIG. 3. The electrode rod 110 is raised by supplying hydraulic oil through the piston rod 121 above the piston 120. When hydraulic oil is introduced beneath the piston 120, the electrode rod 110 is lowered. By co-operation of the aforedescribed structural parts by electrode 111 together with the electrode rod 110 can be raised or lowered relative to the fixed column 102, axial holder 103, electrode carrying device 104, columns 119 and the crossbar 122. The parts 119, 122 and 135 together form a guide arrangement 108.

Figure 8:
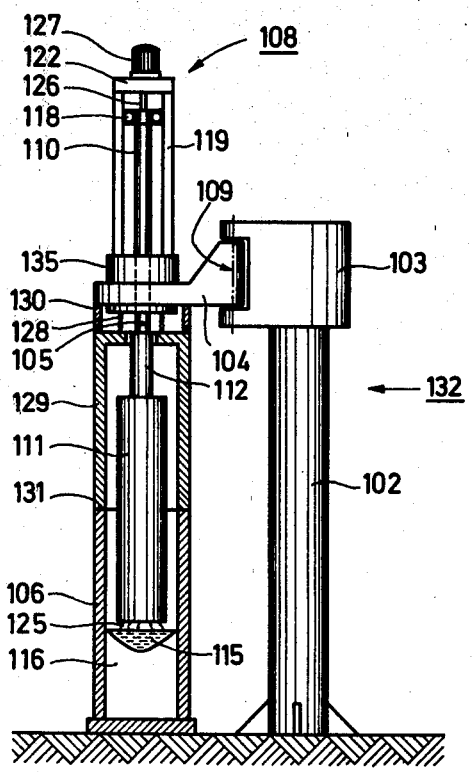
FIG. 8 is a diagrammatic side view of a vacuum electric arc remelting plant according to the invention and similar to FIG. 7, with the mold and upper part of the furnace being shown in section.

FIG. 8 shows a similar device 132, such as can be used in the vacuum electric arc remelting process (VAR process). The fixed column 102 together with the axial holder 103 as well as the electrode carrying device 104 with the electrode clamping device 105 are again present. The water-cooled mold 106 contains the ingot 116 and the bath of molten metal 115. The electrode 111 is melted by means of the electric arc 125 produced between the electrode 111 and the molten metal 115. The electrode rod 110 is moved via a spindle 126 driven by a motor 127. To this end, a spindle nut is arranged in the transverse crossbar 118. The spindle 126 is arranged coaxially in a known manner in the electrode rod 110. The motor 127 is supported directly on the electrode carrying device 104 via the crossbar 122 and columns 119, in the manner described in more detail in FIG. 9. The mold 106, which in the case of a vacuum electric arc furnace can at the same time be regarded as the lower part of the furnace, is closed at the top by a furnace upper part 129, which is connected directly to the electrode carrying device 104 via a compensator (bellows) 128 in the manner illustrated in FIG. 9. The furnace upper part 129 is suspended by means of tension rods 130 on the electrode carrying device 104, and is sealed with respect to the mold 106 by means of a seal 131.

Instead of the electrode carrying device 104 being able to pivot about the axis 109, a translational movement of the electrode carrying device 104 within the mold can also be implemented by securely connecting the carrying device 104 to the fixed column 102. In this case the fixed column 102, which can also have a plurality of supporting feet, is arranged so that it can move linearly on guide rails by means of wheels. In the case of large pivotal radii these guide rails can be laid along a circular arc.

In FIG. 9 the elements that are the same as those in FIG. 8 are provided with identical reference numerals. FIG. 9 shows the outer end of the electrode carrying device 104, which also contains the electrode clamping device 105. An essential component is an externally cylindrical electrode holding member 135 in which the two columns 119 that carry the upper crossbar 122 are secured. The transverse crossbar 118 lying thereunder is guided on the columns 119 by means of two rollers 136, and the electrode rod 110 is suspended on the transverse crossbar 118. The clamping end 112 is secured by means of two round keys 137 in the electrode clamping device 105 at the lower end of the electrode rod 110. The electrode rod 110 is very finely machined and is in addition guided in a sealing member 138 containing radial bearings for guidance purposes. The sealing member 138 can be in the form of a stuffing box packing which seals the electrode rod 110 in a vacuum-tight manner. It is however particularly advantageous to make the sealing member 138 in the form of a so-called pressure stage section in which the necessary degree of airtightness can be achieved by a labyrinth-like succession of chambers with intermediate suction. The sealing member 138 is bolted to the lower part of the electrode holding member 135 and is connected in a vacuum-tight manner via the compensator 128 to the furnace upper part 129. The electrode holding member 135, which should be regarded as a reference platform as regards the behavior of the forces in the described system, is mounted in the electrode carrying device 104 with the aid of pegs 139 and 140. Spherical bearings 141 and 142 are situated in the electrode holding member 135 at the engagement points of the pegs 139 and 140. The peg 139 is rigidly secured to the electrode carrying device 104, whereas the peg 140 is securely arranged in a slide valve 143 guided in a vertically movable manner in the electrode carrying device 104. The slide valve 143 is suspended via its upper end on an eccentric pin 144 of an eccentric or cam 145, which is mounted on the electrode carrying device 104 and is moved by means of an adjustment drive means 147 via a lever arm 146. A lever arm 148 is also secured to the upper part of the electrode holding member 135, and is connected to an adjustment drive means 149 and is moved by the latter.

The angular adjustment of the electrode holding member 135 with respect to the electrode carrying device 104 is effected by actuating the adjustment drive means 149 about an axis X—X running through the two spherical bearings 141 and 142. Upon actuating the adjustment drive means 147 the slide valve 143 is moved vertically via the eccentric peg 144 and the peg 140 is thereby raised or lowered. In this way there is produced an adjustment about an axis Y—Y which lies horizontally and is displaced by 90° with respect to the axis X—X, and which runs through the center of the spherical bearing 141. The middle of the compensator 128 is roughly at the height of the pegs 139 and 140. Only a minimal angular or axial movement of the compensator 128 thus takes place when there is an X—Y adjustment of the electrode holding member 135.

The electrode holding member 135 is a direct holding means for the electrode 111, namely via the columns 119, the brossbar 122, the spindle 126, the spindle nut (not described in more detail), the transverse crossbar 118, the electrode rod 110 and the electrode clamping device 105 which firmly holds the clamping end 112 in a positive locking manner by means of the round keys 137. The electrode holding member 135 is however responsible, as a reference platform and as a central adjustment means for the angular position of the electrode, for adjusting the spatial position of the electrode 111 on the basis of the peg bearing and adjustment drive means.

Current is supplied to the electrode rod 110 and thereby to the electrode 111 via the transverse crossbar 118. A power cable 150 is suspended from the latter, and is moved upon displacement of the electrode rod 110 with respect to a connection point 151 on a busbar 152. The busbar 152 is secured in an insulated manner on the column 119 and carries a flexible power cable connection 153 at its lower end which is connected to the other side of the stationary busbar 154. The flexible power cable connection 153 permits the unhindered X-Y adjustment of the electrode holding member 135. In this connection it is advantageous to arrange the power cable connection 153 as close as possible to the peg 139 in order to cause the least possible deformation of the power cable connection 153 when carrying out an X-Y adjustment.

Figure 10:
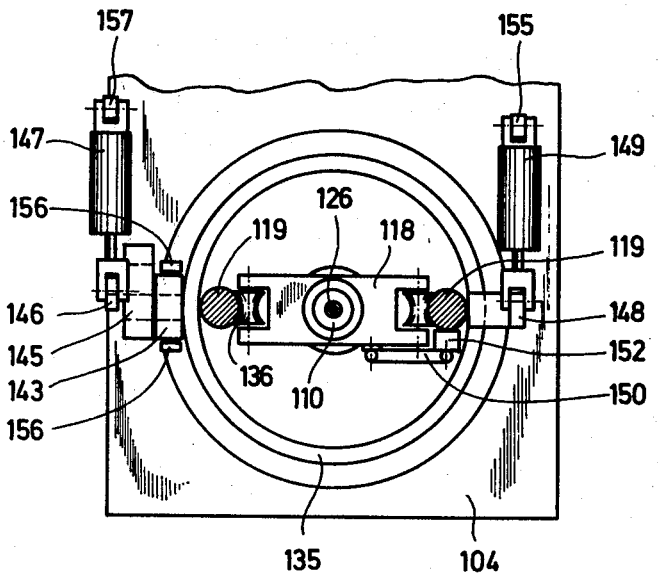
FIG. 10 is a top view of the end of the electrode carrying device according to the invention on which the electrode holding member and its adjustment drive means is located, as is employed in the plant according to FIG. 8, in the cross-section plane X—X according to FIG. 9, and, FIG. 11 illustrates details of the electrode carrying device according to the invention in cross-section, as is used in the plant according to FIG. 7.

In FIG. 10 those elements that are the same as in FIGS. 8 and 9 are provided with identical reference numerals. FIG. 10 is a top view of the end of the electrode carrying device 104, in which the electrode holding member 135 is mounted in the described manner. The rollers 136 run on the columns 119 and guide the transverse crossbar 118 together with the spindle nut and spindle 126. The columns 119 are secured in the cylindrical electrode holding member 135. The position of the busbar 152 on the column 119 and the position of the power cable 150 together with the connection to the transverse crossbar can also be recognized. The lever arm 148, which is moved by the adjustment drive means 149, is situated on the upper edge of the electrode holding member 135. This adjustment drive means is connected by means of a holder 155 to the electrode carrying device 104. The slide valve 143, which is guided vertically on the electrode carrying device 104 by means of the guides 156 and which is moved by the adjustment drive means 147 by means of the eccentric 145 via the lever 146, can in addition be recognized. The adjustment drive means 147 is likewise mounted on the electrode carrying device 104 by means of a holder 157.

In FIG. 11 the elements that are the same as those in FIGS. 7 and 9 are provided with identical reference numerals. FIG. 11 shows an electrode holding member 135 in section, as is used in the device according to FIG. 7. Instead of the sealing member 138 shown in FIG. 9, a power supply member 160 is bolted to the lower part of the cylindrical electrode holding member 135. The power supply member 160 contains, in a known manner, radial bearings and electrical slide contacts through which the melting current is supplied to the electrode rod 110 and thus to the clamping end 112 of the electrode. The power is fed via a flexible cable 161 from a busbar 162 to the power supply member 160. The cylindrical electrode holding member 135 is mounted on the pegs 139 and 140 in a manner exactly similar to that shown in FIG. 9. The X-Y adjustment also takes place in a manner identical to that illustrated in FIG. 9.

FIG. 11 also shows the possibility of the further development of the subject matter of the invention, which is also to be used in a similar manner with respect to the subject matter of FIG. 9. An intermediate frame 163, which can be regarded as belonging to the electrode carrying device 104 and in which the peg 139 is mounted, is arranged between the electrode carrying device 104, which is suitably modified, and the electrode holding member 135. The peg 140 arranged on the opposite side is mounted on the slide valve 143, whose reaction forces are likewise transmitted to the intermediate frame 163. A plurality of weight measuring cells 164, by means of which the total weight of the parts carried by the weight measuring cells can be measured, are distributed on the circumference, between the intermediate frame 163 and the electrode carrying device 104. The weight of the electrode in each case is given by subtracting the total weight of the parts belonging to the plant. In general three weight measuring cells are arranged uniformly distributed on the circumference, the sum of all the measurement values giving the aforedescribed total weight.

The intermediate frames 32 and 163 are of course guided in the horizontal direction by means of so-called longitudinal connecting rods so that the pressure measuring cells 33 and 164 between the intermediate frames and the electrode carrying devices 14 and 104 adopt a defined, guided position and cannot be deflected sideways.

It will be clear to those skilled in the art, that while pressure medium cylinders were specified as the active element for the adjustment drive means, these can be charged with hydraulic or pneumatic fluids and that it is, however, directly possible and within the teachings of the invention to replace these pressure medium drive means by, for examplem, electric adjustment means preferably equipped with self-stopping and/or locking devices for maintaining their position.

It will be appreciated that the instant specification and example are set forth by way of illustration and not limitation, and that various modifications and changes may be made without departing from the spirit and scope of the present invention.

What is claimed is:

1. In an electroslag remelting plant having a mold, an electrode carrying device and an electrode clamping device having an electrode holding member for holding an electrode and at least one adjustment means for adjusting the angular position of the electrode holding member and thereby the held electrode, the improvement wherein the adjustment means comprises means defining solely two discrete pivot axes for the electrode holding member which are aligned substantially at right angles to one another and independently controllable adjustment drive means for effecting pivotal movement of the electrode holding member about the two axes.

2. The electrode clamping device according to claim 1, wherein both pivot axes extend horizontally.

3. The electrode clamping device according to claim 1, wherein the electrode carrying device is pivotable together with the adjustment means about a vertical axis to position the adjustment means along a circular path and wherein one pivot axis is aligned tangentially to the circular path and the other pivot axis is aligned at the vertical axis.

4. The electrode clamping device according to claim 1, or claim 2, wherein the electrode carrying device is swivelable together with the adjustment means about a vertical axis to position the adjustment means along a circular path and wherein one pivot axis is aligned tangentially to the circular path and the other pivot axis is aligned parallel to a radius of the circular path.

5. The electrode clamping device according to claim 1, wherein one adjustment drive means for effecting pivotal movement of the holding member about one pivot axis is disposed between the electrode holding member and the electrode carrying device.

6. The electrode clamping device according to claim 1 or claim 2, wherein the means defining one pivot axis comprises two pegs engaging bilaterally with the electrode holding member, a swivel pin rotatably mounted on the electrode carrying device, wherein one peg is rigidly secured to the electrode carrying device and the other peg is secured to the swivel pin and displaced eccentrically by a given amount, wherein the one pivot axis and the rotational axis of the swivel pin in its central position lie in a horizontal plane and wherein spherical bearings are arranged between the pegs and the electrode holding member.

7. The electrode clamping device according to claim 6, the other adjustment drive means is disposed between the swivel pin and the electrode carrying device for adjusting the swivel pin about its rotational axis and thereby the electrode holding member about the other pivotal axis passing through one of the spherical bearings.

8. The electrode clamping device according to claim 1, wherein the electrode holding member comprises a horizontally orientated U-shaped member and two centering members mutually acting radially with respect to the held electrode.

9. The electrode clamping device according to claim 8, wherein the centering members have conical surfaces whose vertices are directed downwardly.

10. The electrode clamping device according to claim 8, wherein the centering members are disposed in the direction of the opening of the U-shaped member with upwardly directed conical surfaces and wherein the electrode includes collars which are insertable behind the conical surfaces in a positive locking manner.

11. The electrode clamping device according to claim 1, further comprising a pair of contact jaws for supplying the melting current to the held electrode, means mounting the jaws beneath the electrode holding member and locking means for preventing the unintentional raising of the held electrode and connected to the pair of contact jaws.

12. The electrode clamping device according to claim 5, further comprising a jib disposed on the electrode, holding member and having a spherical bearing connecting the jib to the one adjustment drive means and wherein the midpoint of the spherical bearing is arranged on the other pivot axis and outside the one pivot axis.

13. The electrode clamping device according to claim 1, further comprising an intermediate frame and a plurality of weight measuring cells supporting the intermediate frame on the electrode carrying device and wherein the pivot axes and their adjustment drive means are disposed on the intermediate frame.

14. The electrode clamping device according to claim 1, further comprising an electrode rod, guide means secured to the electrode holding member for effecting axially displacement of the electrode rod relative to the electrode carrying device and drive means secured to the electrode holding member for displacing the electrode rod.

15. The electrode clamping device according to claim 14, wherein the guide means comprises a vertical frame including columns and a crossbar and wherein the electrode rod is guided parallel to the columns.

16. The electrode clamping device according to claim 15, wherein the guide means further comprises a transverse crossbar at the upper end of the electrode rod and rollers supporting the transverse crossbar on both sides on the columns.

17. The electrode clamping device according to claim 14, wherein the electrode holding member comprises a hollow body and a sealing member in its interior which surrounds the electrode rod in a vacuum-tight manner and further comprising a furnace upper part and a compensator connecting the furnace upper part to the sealing member.

18. The electrode clamping device according to claim 17, wherein the center of the compensator substantially lies in the plane defined by the two pivot axes.

19. The electrode clamping device according to claim 14, wherein the electrode holding member comprises a hollow body and a power supply member in its interior which surrounds the electrode rod and further comprising a stationary busbar and a flexible cable connecting the busbar to the power supply member.

20. The electrode clamping device according to claim 14, wherein the means defining one pivotal axis comprises two pegs engaging bilaterally in the electrode holding member, wherein one of the pegs is securely fastened to the electrode carrying device and means mounting the other peg including a gate valve such that it is displacable in height by a given amount, wherein the gate valve is mounted on the said electrode carrying device for vertical adjustment and the one pivot axis and the other peg in its mid-height position lie in a horizontal plane, and further comprising spherical bearings disposed between the pegs and the electrode holding member.

21. The electrode clamping device according to claim 20, wherein one adjustment drive means is disposed between the gate valve and electrode carrying device to adjust the height of the gate valve and thereby the electrode holding member about the other pivotal axis passing through one spherical bearing.

* * * * *